US008112917B1

(12) United States Patent
Tameo

(10) Patent No.: US 8,112,917 B1
(45) Date of Patent: Feb. 14, 2012

(54) IRONING AID

(76) Inventor: Michael N. Tameo, Charlestown, MA (US)

( * ) Notice: Subject to any disclaimer, the term of this patent is extended or adjusted under 35 U.S.C. 154(b) by 308 days.

(21) Appl. No.: 12/615,433

(22) Filed: Nov. 10, 2009

(51) Int. Cl.
*D06F 71/29* (2006.01)
*D06F 79/00* (2006.01)

(52) U.S. Cl. ..... 38/141; 223/63; 223/74

(58) Field of Classification Search ..... 38/69, 70, 38/141, 144; 223/66–74
See application file for complete search history.

(56) References Cited

U.S. PATENT DOCUMENTS

| | | | | | |
|---|---|---|---|---|---|
| 928,424 | A | | 7/1909 | Betts | |
| 972,662 | A | * | 10/1910 | Takano | 38/70 |
| 1,106,137 | A | | 8/1914 | Doyle | |
| 1,177,631 | A | | 4/1916 | Johnson | |
| 1,204,593 | A | * | 11/1916 | Rice | 38/70 |
| 1,343,397 | A | | 6/1920 | Leth | |
| 1,352,158 | A | * | 9/1920 | Thomas | 38/70 |
| 1,426,871 | A | | 8/1922 | Hren | |
| 1,524,551 | A | * | 1/1925 | Hogman | 223/63 |
| 1,755,893 | A | * | 4/1930 | Prebensen | 223/63 |
| 1,789,638 | A | * | 1/1931 | Pullman et al. | 38/108 |
| 1,881,833 | A | * | 10/1932 | Mitar | 223/63 |
| 2,030,786 | A | | 2/1936 | French | |
| 2,423,521 | A | | 7/1947 | Selby | |
| 2,488,617 | A | | 11/1949 | Butcher | |
| 2,489,052 | A | | 11/1949 | Silva | |
| 2,642,209 | A | * | 6/1953 | Davis | 223/57 |
| 2,670,110 | A | | 2/1954 | Harris | |
| 2,805,008 | A | | 9/1957 | Burrows | |
| 3,174,663 | A | * | 3/1965 | Campbell | 223/74 |
| 3,194,456 | A | | 7/1965 | Gayring | |
| 3,482,744 | A | | 12/1969 | Schlemon | |
| 3,506,170 | A | | 4/1970 | Rosenthal | |
| 3,739,959 | A | * | 6/1973 | Gordon | 223/63 |

* cited by examiner

*Primary Examiner* — Ismael Izaguirre
(74) *Attorney, Agent, or Firm* — Salter & Michaelson

(57) ABSTRACT

An ironing aid for assisting in ironing of clothing including at least pants and shirts by extending inside of a sleeve or pant leg. The ironing aid includes an elongated handle extending along a longitudinal handle axis and including proximal and distal ends with the proximal end for grasping by a user for insertion into a sleeve or pant leg; a support block having one and other ends with the handle mounted at the one end thereof; a pair of arms each having respective proximal and distal ends with the distal ends thereof for contact inside of the pant leg or sleeve to provide a pressing action by an iron as the ironing aid is moved inside the clothing in advance of the iron, said pair of arms capable of transitioning between open and more closed positions; a pivot for respectively supporting the pair of arms on either side of the longitudinal axis and from the other side of the support block; and a spring disposed between the pair of arms for biasing the arms to an open position to contact inside the clothing.

20 Claims, 13 Drawing Sheets

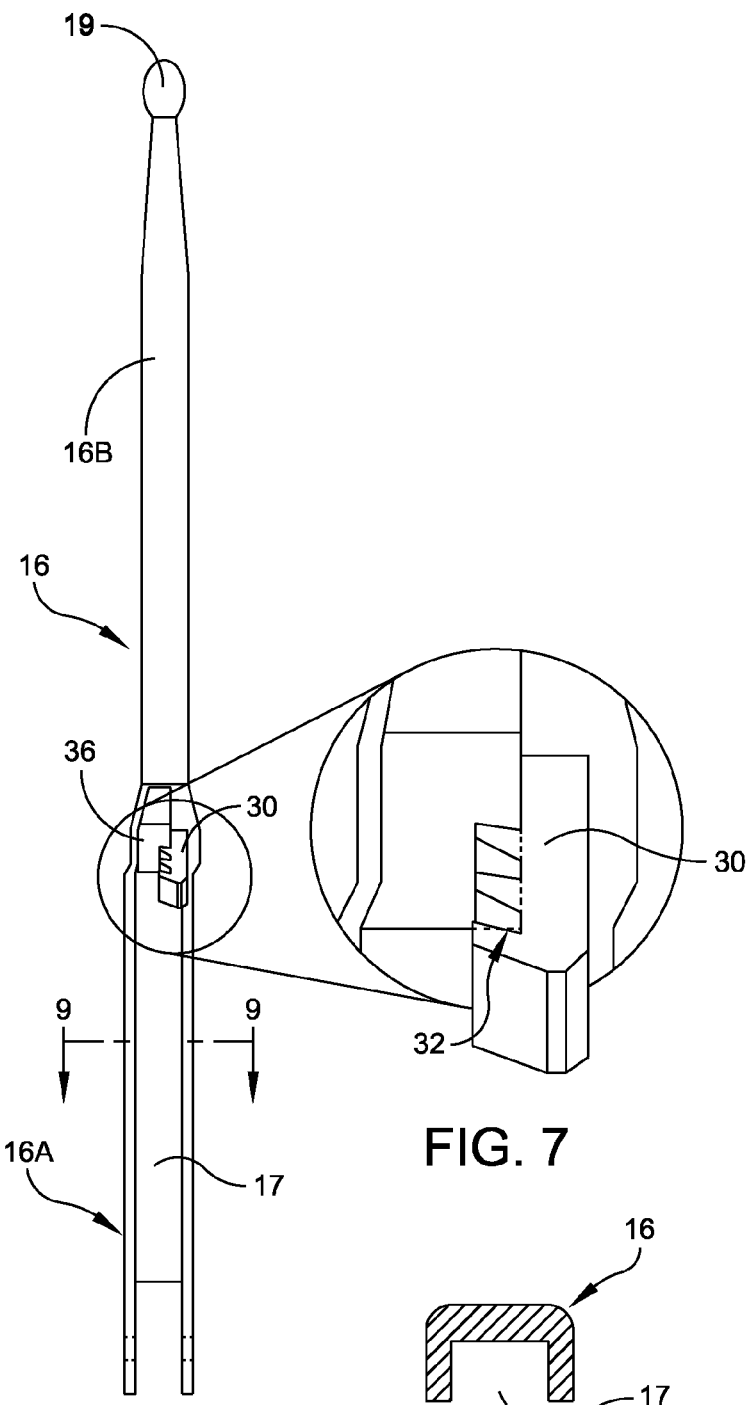
FIG. 6
FIG. 7
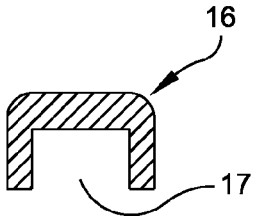
FIG. 9
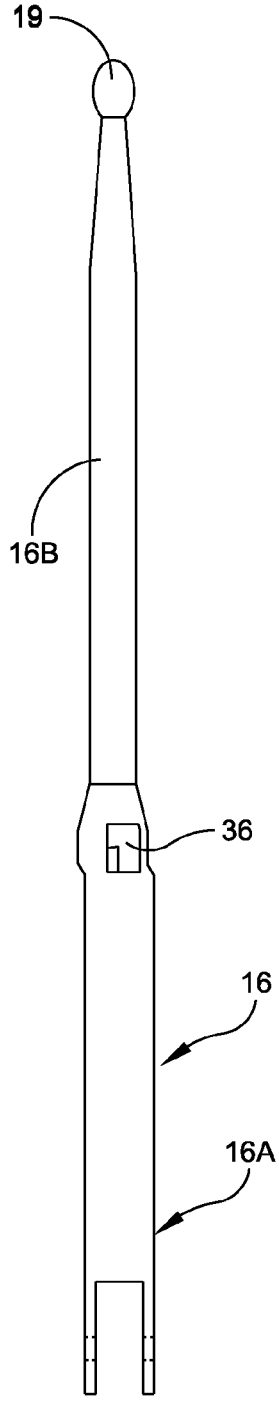
FIG. 8

IRONING AID

TECHNICAL FIELD

The present invention relates in general to an ironing aid, and pertains, more particularly, to a simple device that can be used manually to assist in the ironing of various types of clothing including, but not limited to, shirts, blouses and pants.

BACKGROUND OF THE INVENTION

There are various types of prior art devices that are meant to be inserted into the sleeve of a shirt or the pant leg of a pair of pants. However, for the most part these devices are meant to be used in a stationary manner and as such, do not aid substantially in the ironing of the shirt or pants. Other prior art devices are relatively complex in construction and thus relatively expensive to manufacture.

Accordingly, it is an object of the present invention to provide an ironing aid that readily fits within a sleeve or leg of clothing but that is readily withdrawn as the ironing takes place.

Another object of the present invention is to provide an ironing aid that is of relatively simple construction and that can thus be manufactured relatively inexpensively.

A further object of the present invention is to provide an ironing aid that is readily adapted to the ironing of different sizes of clothing.

SUMMARY OF THE INVENTION

To accomplish the foregoing and other objects, features and advantages of the present invention there is provided an ironing aid for assisting in the ironing of clothing. The ironing aid comprises: a handle extending along a longitudinal axis and including proximal and distal ends with the proximal end for grasping by a user; a support block having one and other ends with the handle mounted at the one end thereof; a pair of arms each having respective proximal and distal ends with the distal ends thereof for contact inside of the clothing to enable a pressing action by an iron as the ironing aid is moved inside the clothing, said pair of arms capable of transitioning between open and more closed positions; a pivots for respectively supporting the pair of arms on either side of the longitudinal axis and from the other side of the support block; and a spring disposed between the pair of arms for biasing the arms to an open position to contact inside the clothing.

In accordance with other aspects of the present invention the spring may comprise either a torsion spring or a leaf spring having respective ends that contact the arms; the other end of the support block is preferably open to receive the pair of arms therein; the pivot may comprise a pivot pin that extends orthogonal to the longitudinal axis of the handle; including a pair of latch pieces that are supported respectively from the pair of arms in relative facing direction; wherein the pair of latch pieces each have engagement members that lock together the latch pieces; wherein the engagement members include a ratchet mechanism between the pair of latch pieces; including an extension mounted at the distal end of each of the arms; and wherein each arm includes an arm base that is pivotally supported from the support block and an arm stick supported from the base, the arm base having a channel for receiving the arm stick, the arm stick having at a distal end thereof a contact piece.

In accordance with another embodiment of the present invention there is provided an ironing aid for assisting in ironing of clothing including at least pants and shirts by extending inside of a sleeve or pant leg. The ironing aid comprises: an elongated handle extending along a longitudinal handle axis and including proximal and distal ends with the proximal end for grasping by a user for insertion into a sleeve or pant leg; a support block having one and other ends with the handle mounted at the one end thereof; a pair of arms each having respective proximal and distal ends with the distal ends thereof for contact inside of the pant leg or sleeve to provide a pressing action by an iron as the ironing aid is moved inside the clothing in advance of the iron, said pair of arms capable of transitioning between open and more closed positions; means for pivotally and respectively supporting the pair of arms on either side of the longitudinal axis and from the other side of the support block; and spring means for biasing the arms to an open position to contact inside the pant leg or sleeve.

In accordance with still other aspects of the present invention the spring means may comprise either a torsion spring or a leaf spring having respective ends that contact the arms; the other end of the support block is preferably open to receive the pair of arms therein, and the means for supporting the arms may comprise a pivot pin that extends orthogonal to the longitudinal axis of the handle; including a pair of latch pieces that are supported respectively from the pair of arms in relative facing direction; wherein the pair of latch pieces each have engagement members that lock together the latch pieces, and wherein the engagement members include a ratchet mechanism between the pair of latch pieces; including an extension mounted at the distal end of each of the arms; and wherein each arm includes an arm base that is pivotally supported from the support block and an arm stick supported from the base, the arm base having a channel for receiving the arm stick, the arm stick having at a distal end thereof a contact piece.

In accordance with the present invention there is also provided a method of ironing clothing by means of an ironing aid manipulated by a user and that is comprised of a handle that supports a pair of arms each having a distal clothing contact end for contact inside of the clothing, the arms biased to enable the arms to be spread apart, said method comprising: at least partially closing the arms against the bias; inserting the arms within the clothing while at least partially closed; next releasing the arms so that the arms engage portions of the clothing thus holding the clothing in a taut state ready for ironing; and sweeping the arms along the clothing in advance of an ironing step so as to enable a pressing action by the iron as the ironing aid is moved in a swept manner inside the clothing. Other steps may include extending the length of the arms by adding an extension mounted at the distal end of each of the arms; holding the arms in a particular position therebetween by means of a latch mechanism; and releasing the latch mechanism so that the arms can be biased apart.

DESCRIPTION OF THE DRAWINGS

Numerous other objects, features and advantages can be realized in accordance with the present invention by referring to the accompanying drawings, in which:

FIG. 6 is a side view of the arm;

FIG. 7 is an exploded view of a portion of FIG. 6 at the area where the latch mechanism is located;

FIG. 8 is an opposite side view to that shown in FIG. 6;

FIG. 9 is a cross-sectional view taken along line 9-9 of FIG. 8;

DETAILED DESCRIPTION

Figure 1:
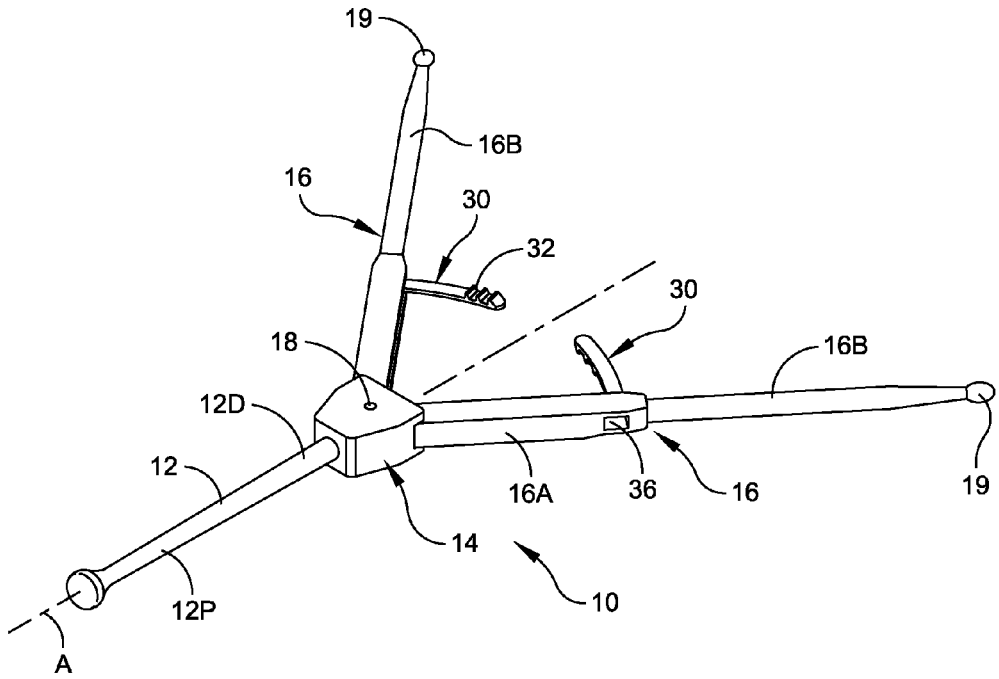
FIG. 1 is a perspective view of an ironing aid that is constructed in accordance with the present invention and illustrated in an open position.
Figure 2:
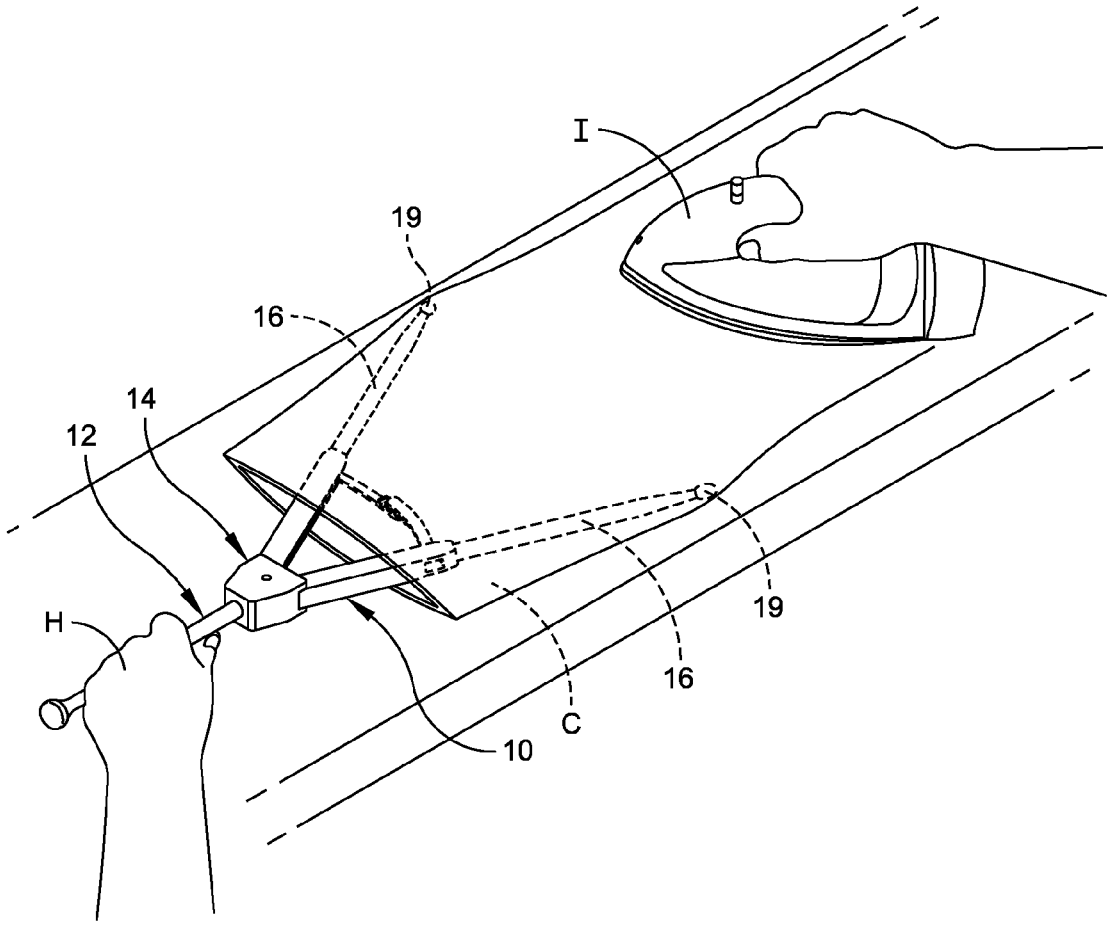
FIG. 2 is a perspective view of the ironing aid of FIG. 1 as used in the ironing of a pant leg or shirt sleeve.
Figure 3:
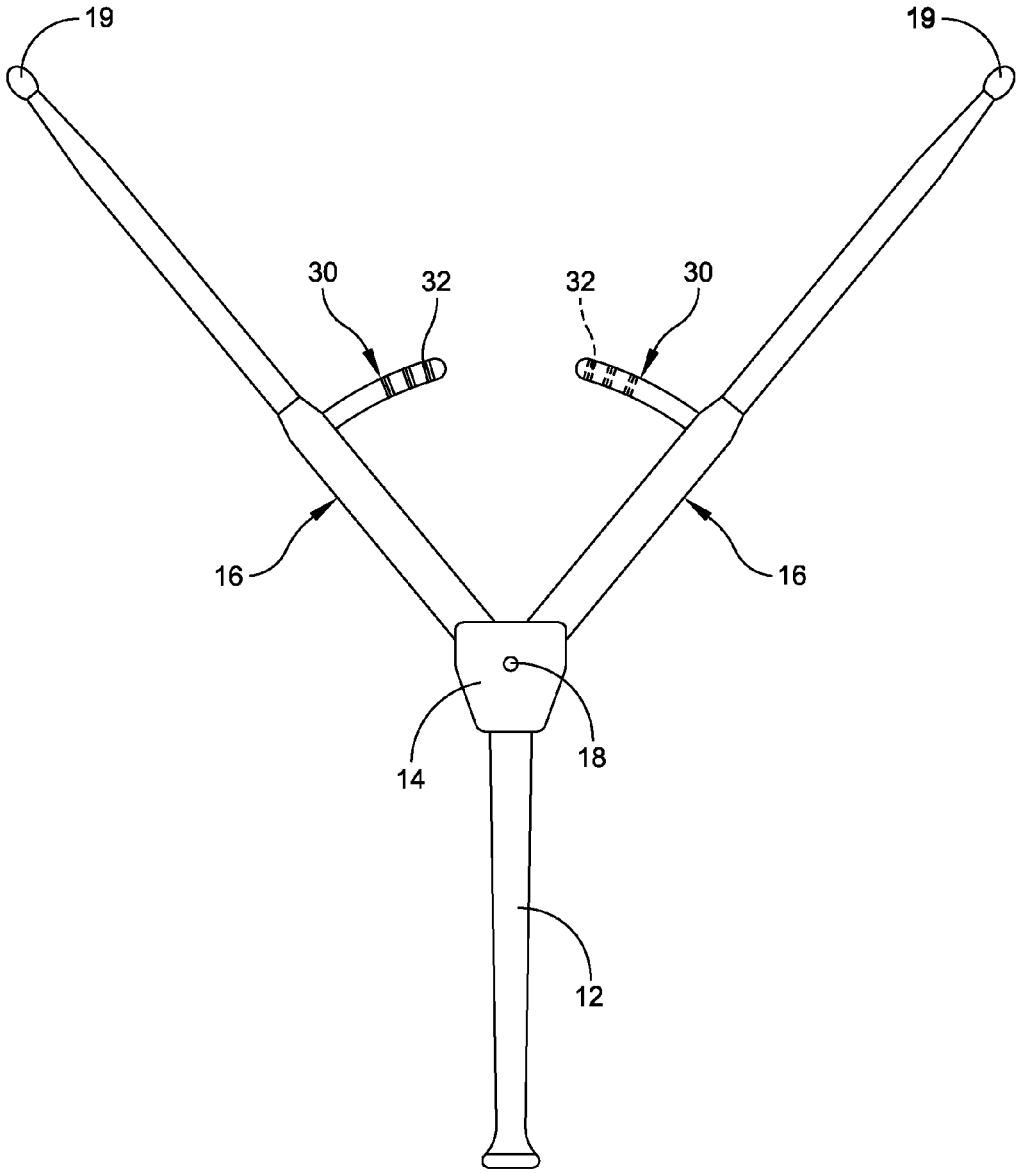
FIG. 3 is a top plan view of the ironing aid of FIG. 1.
Figure 4:
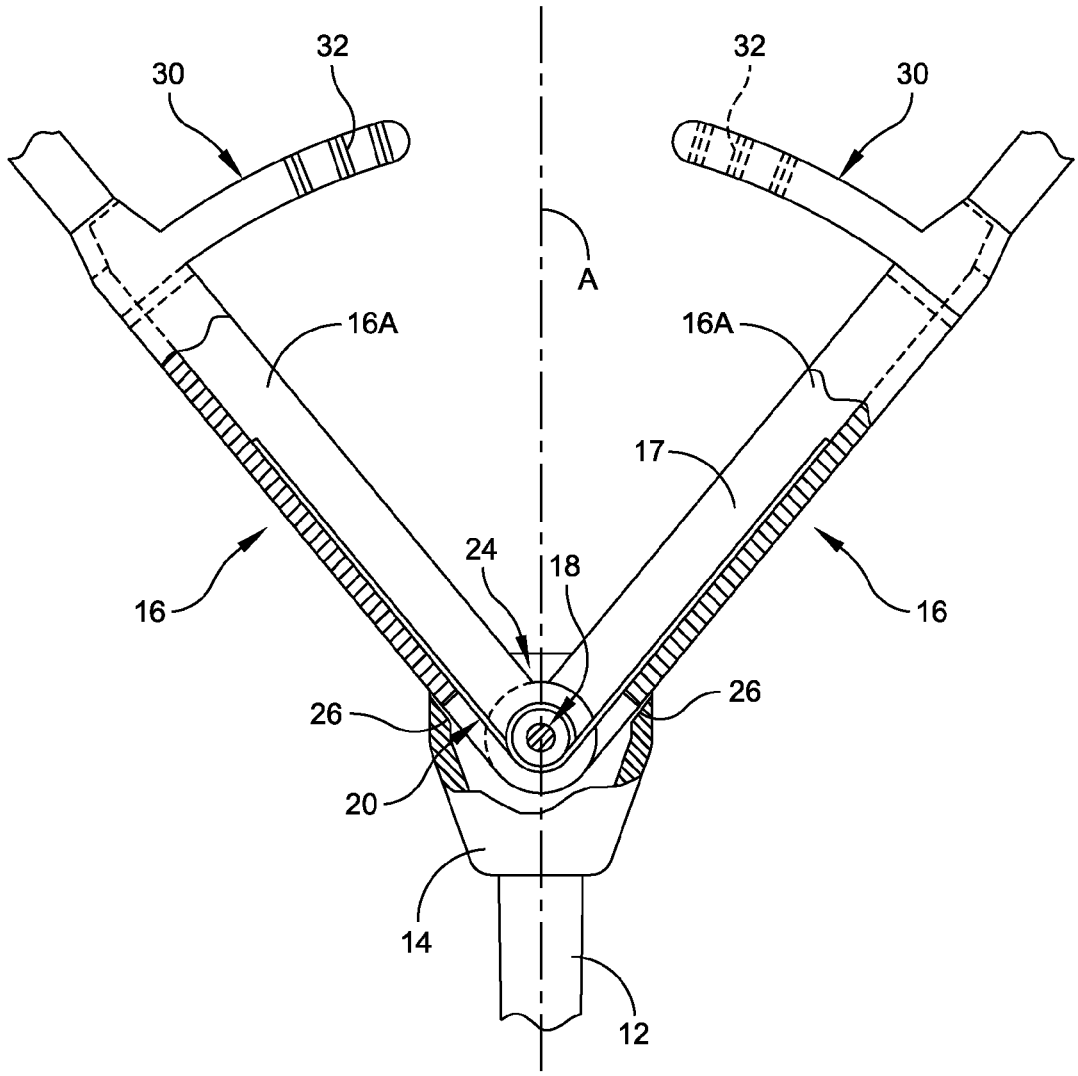
FIG. 4 is a fragmentary top plan view of the ironing aid with portions cut-away.
Figure 5:
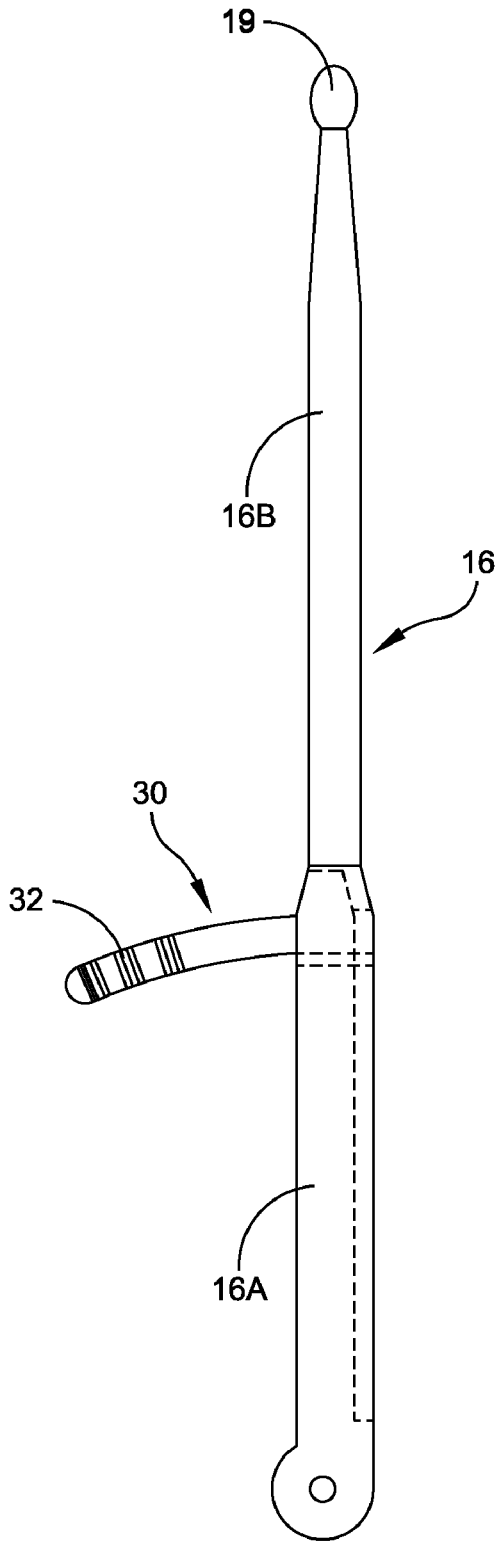
FIG. 5 is a side elevation view of one of the arms of the ironing aid.

The present invention is illustrated in the drawings as an ironing aid 10. FIG. 1 is a perspective view of the ironing aid constructed in accordance with the principles of the present invention and illustrated in its open or released position. FIG. 2 is also a perspective view of the ironing aid depicted in FIG. 1 and as used in the ironing of a pant leg or shirt sleeve. FIG. 3 is a top plan view of the ironing aid of FIG. 1 and FIG. 4 is a fragmentary top plan view with portions shown in cross section illustrating further details of the mechanism.

The ironing aid is comprised of a handle 12 that may be considered as extending along a longitudinal axis A shown in dotted outline in FIG. 1. The handle 12 has proximal and distal ends with the proximal end 12P for grasping by a user such as illustrated in FIG. 2 where the hand H is grasping about the handle 12.

The ironing aid also includes a support block 14 having one and another ends or sides with the distal end 12D of the handle mounted at one end thereof. The handle 12 may be mounted to the block 14 in a known manner. The handle 12 and support block 14 may be constructed of a number of different types of materials including, but not limited to, wood and plastic. The distal end 12D of the handle may be screwed into the block 14 or attached in any other appropriate manner so that the handle 12 is fixed in position relative to the support block 14. Refer also to the partial cross-sectional view of FIG. 4 which shows a support block 14 partially cut away with the handle 12 fixedly attached to the one end of the support block 14.

The ironing aid also is comprised of a pair of arms 16 which each may be considered as having proximal and distal ends with the distal ends thereof for contact inside of the clothing to enable a pressing action by an iron as the ironing aid is moved inside of the clothing. Again, refer to FIG. 2 which illustrates the arms 16 inside of the clothing C. FIG. 2 also illustrates an iron I that provides an ironing of the clothing and which is in a position adjacent to the ironing aid 10. As the ironing aid 10 is withdrawn from the sleeve or pant leg, the iron I progresses and is drawn along providing the ironing of the sleeve or pant leg. The pair of arms 16 may be considered as being capable of transitioning between a fully open position as illustrated in FIG. 1 and a more closed position such as illustrated, for example, in FIG. 10 or 12.

Figure 10:
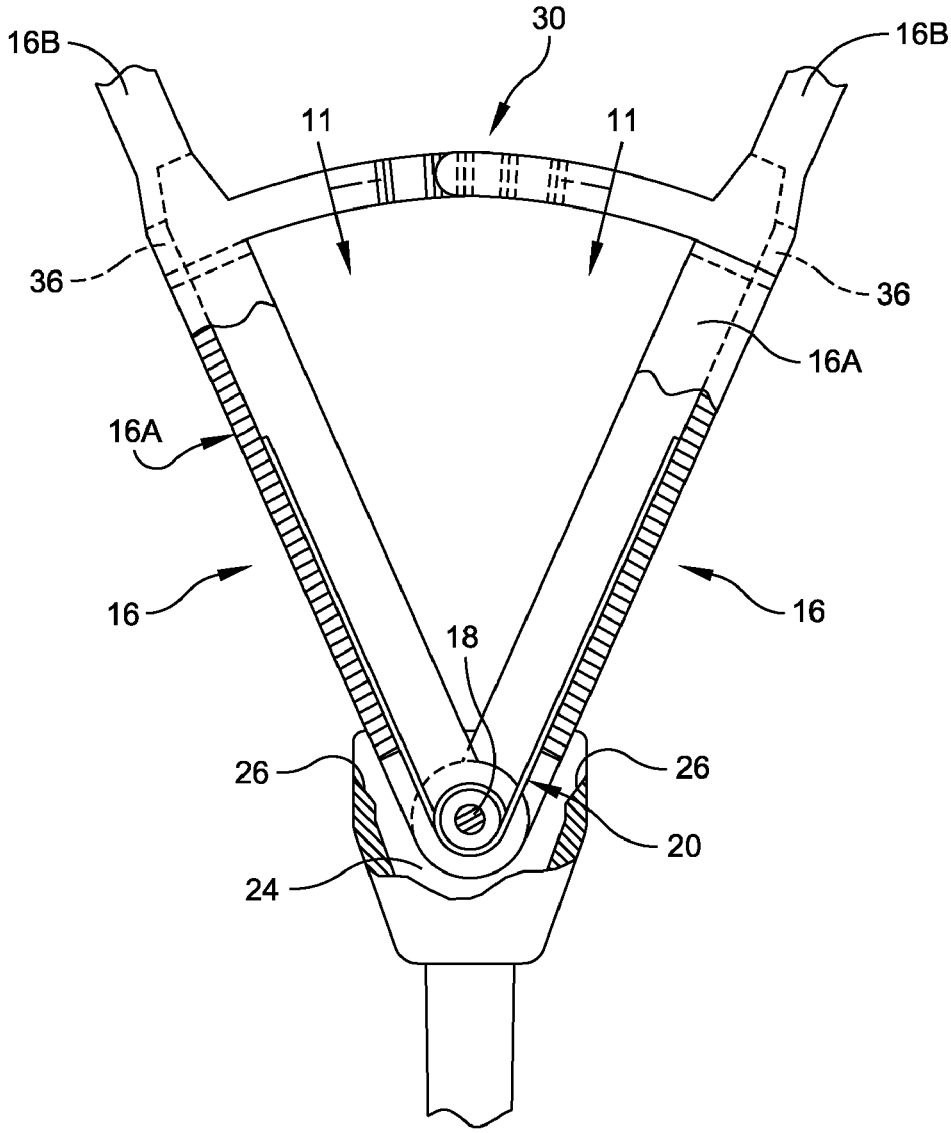
FIG. 10 is a fragmentary plan view illustrating the arms at least partially closed and with the latch mechanism engaged.
Figure 12:
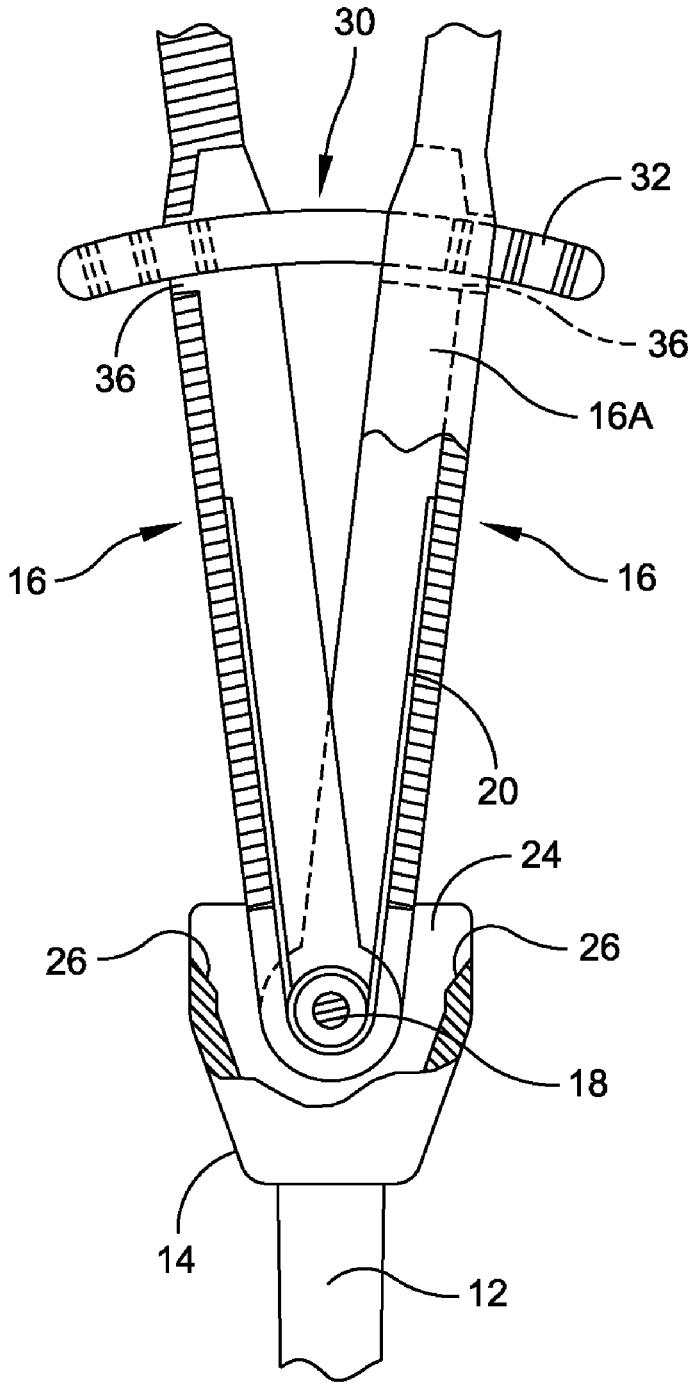
FIG. 12 is a cross-sectional view like that shown in FIG. 10 but with the arms further closed and with the separate latch pieces engaged and passing through opposed arms.

For the support of the arm 16, the ironing aid is further provided with a pivot 18 for respectively and commonly supporting the pair of arms 16. As illustrated in, for example, FIG. 1, the support block 14 is symmetrical as to its support of the arms 16 and thus the arms 16, in the open position thereof, are disposed at an equal angle to the longitudinal axis A. In order to set the arms 12 at their open position, as illustrated in FIG. 1, the ironing aid also includes a spring 20. The spring 20 is best illustrated in FIGS. 4, 10 and 12. This may be a leaf spring or a torsion spring. In the illustrated embodiment, the spring 20 has a center portion that is disposed about the pivot pin 18 and has extending arms that fit within each of the respective legs that extend in the arms 16. The extending legs of the spring 20 bias the arms outwardly such as to the position shown in FIG. 4 where both of the arms are symmetric about the longitudinal axis A. FIG. 4 also depicts the support block 14 which has an opening at its other end. This is shown in FIG. 4 as the opening 24. The pivot pin 18 is fixedly supported within the opening 24 and thus the very proximal ends of the arms are disposed within the opening in the support block 14. The support block 14 is also constructed so that the side walls are at 26 form respective stops for the arms 16 so that they are limited in the extent of their open position.

Figure 13:
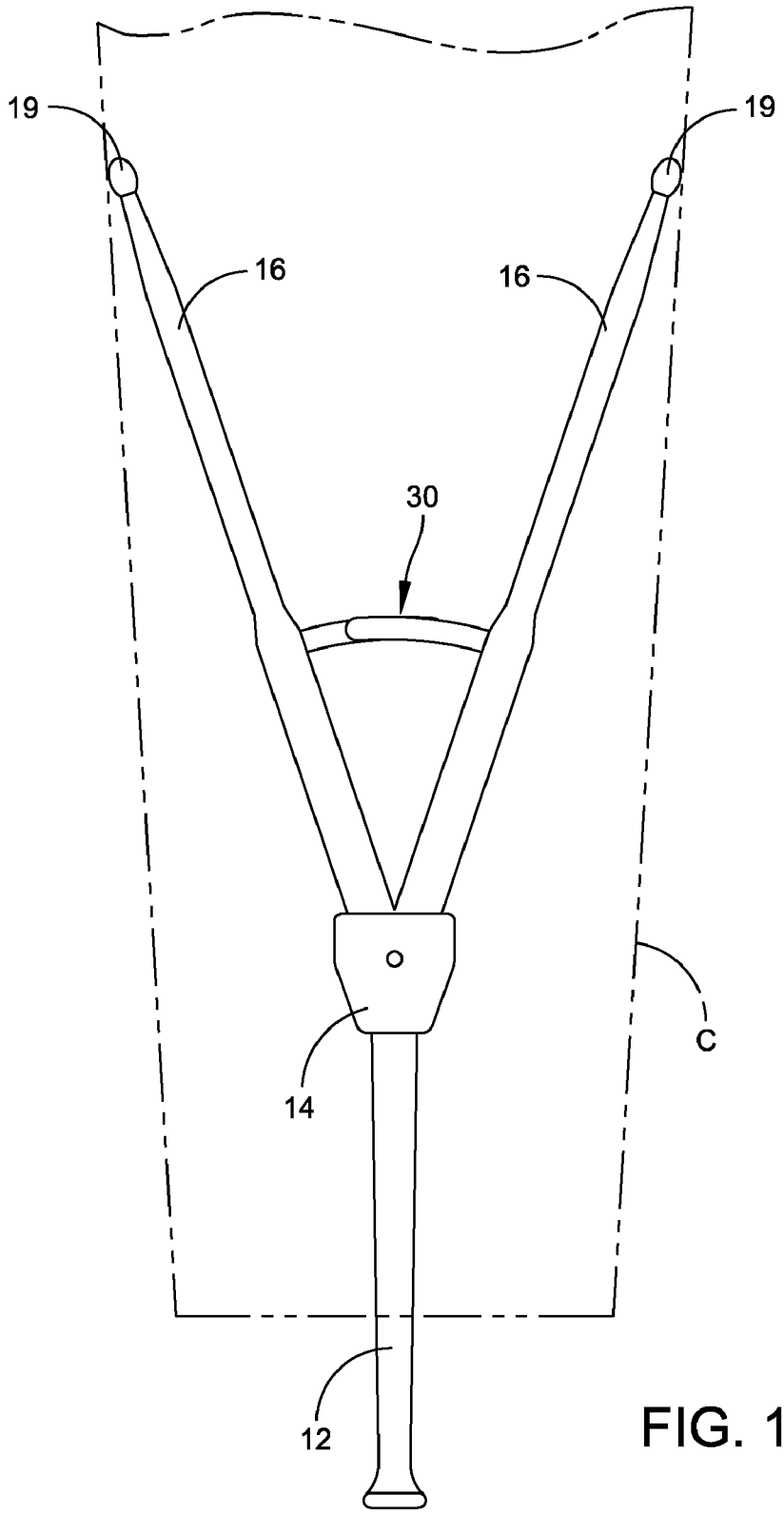
FIG. 13 is a top plan view of the ironing aid as inserted into a piece of clothing which is shown in dotted outline.
Figure 14:
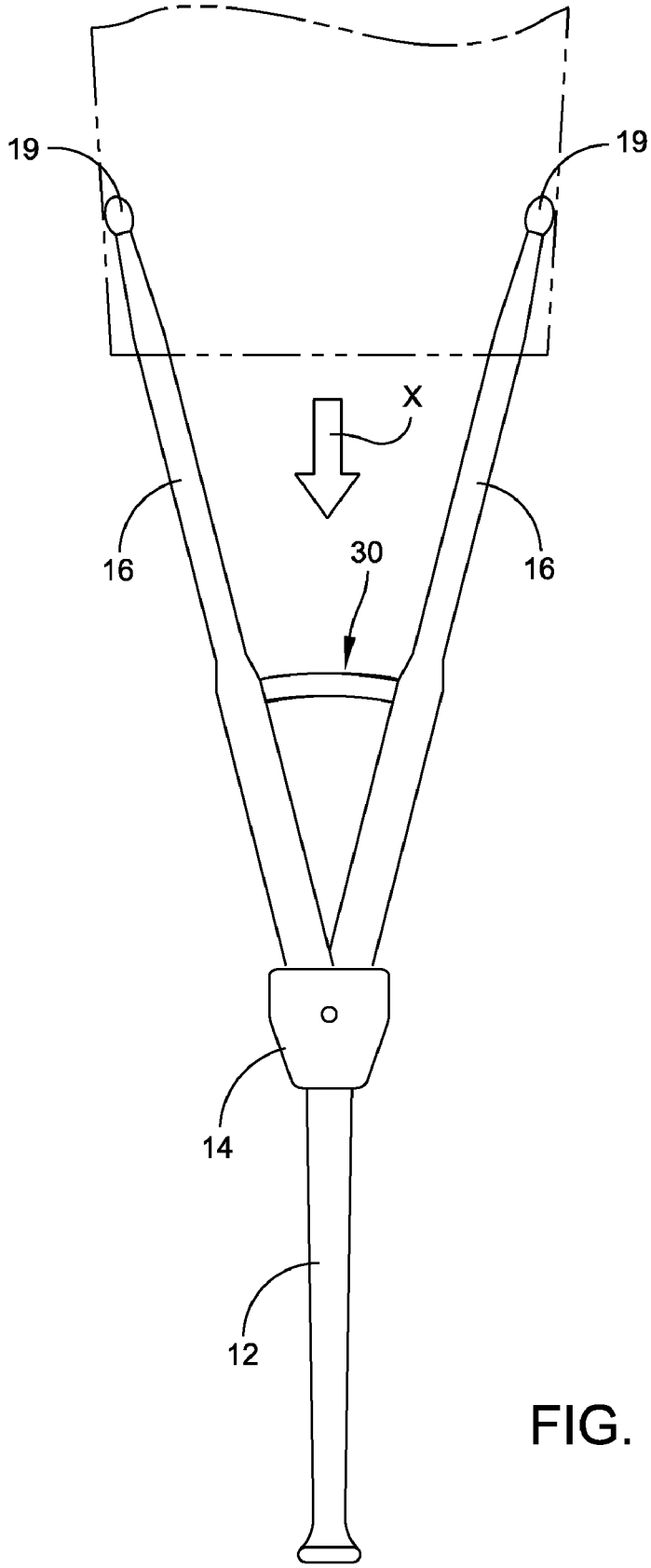
FIG. 14 is a top plan view of the ironing aid as in FIG. 13 but with the ironing aid disposed at an entrance of the clothing being withdrawn.

Further details of the construction of each of the arms 16 is found in FIGS. 5-9. Thus, each arm 16 includes an arm base 16A and an arm stick 16B. It is the arm base 16A that is pivotally supported from the support block 14. The arm base 16A is constructed with a channel 17, the cross section of which is shown in FIG. 9. The arm stick 16B is adapted to fit within the channel 17 and may be supported in an appropriate manner in the channel 17 such as by being glued or screwed to the arm base 16A. The arm stick 16B also preferably has at its distal end, a contact piece 19 that is fixedly supported at the distal free end of the arm stick 16B. Each of the pieces 19 is preferably constructed of a smooth somewhat spherical shape as illustrated. The pieces 19 are what makes direct contact on the inside of the clothing such as depicted in FIGS. 2, 13 and 14. The material of the end pieces 19 could be of a smooth contoured plastic material such as teflon.

Figure 15:
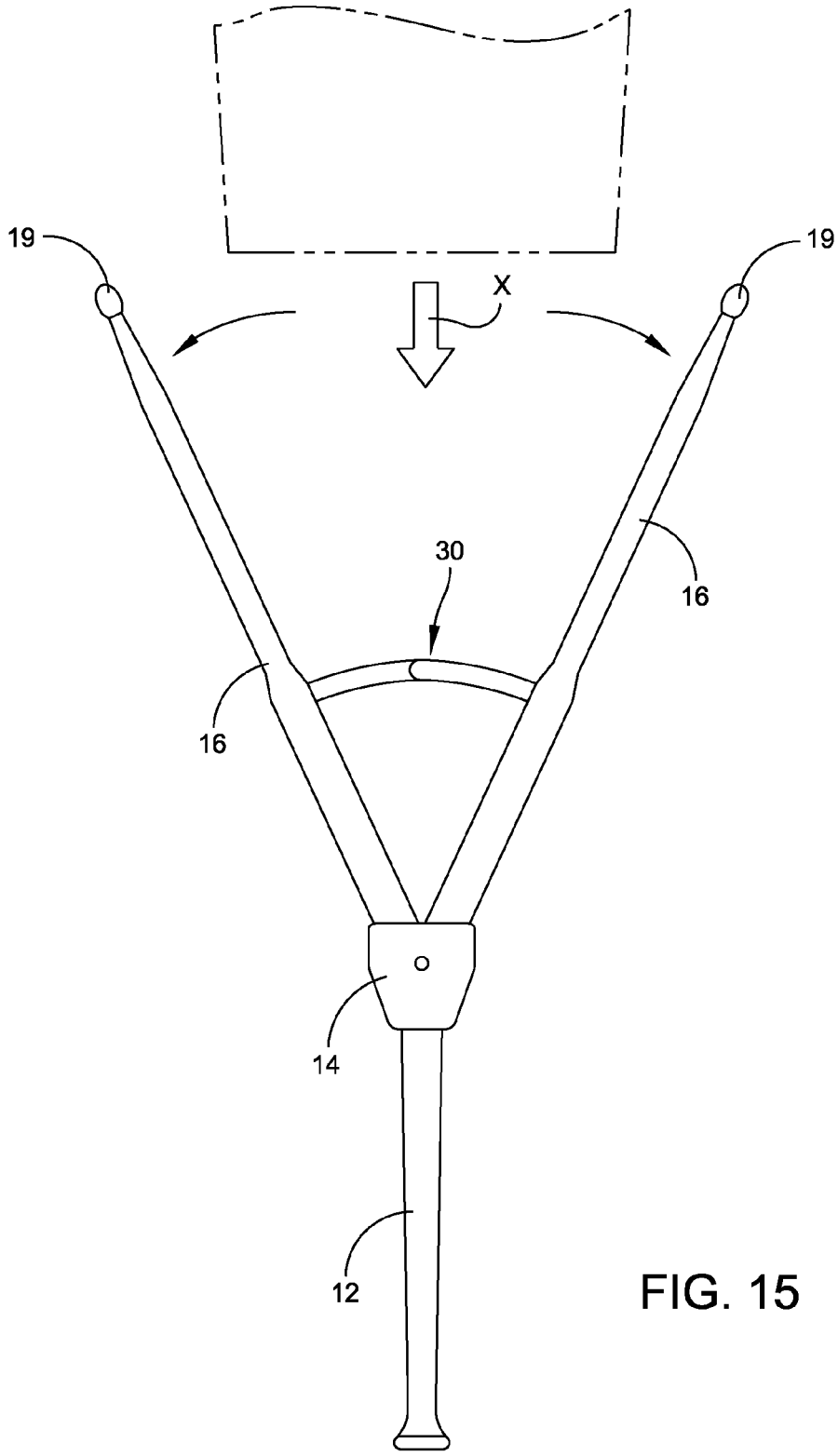
FIG. 15 is a top plan view of the ironing aid as now released from the clothing and illustrating the manner in which the latch mechanism is kept engaged as the ironing aid is withdrawn from the clothing.

The drawings also illustrate a pair of latch pieces 30 that are fixedly supported from the respective pair of arms. FIGS. 1 and 4 illustrate each of the latch pieces 30 supported from a respective arm 16. The latch pieces 30 are meant to interengage and prevent the arms from violently springing apart. In other words, the latch pieces form a lock so that when the ironing aid is withdrawn from a sleeve or pant leg, such as depicted in FIG. 15, the arms 16 can only spring apart a relatively short distance. The latch pieces 30 although engaged, can also be easily released manually so that the ironing aid can again assume the position shown in, for example, FIGS. 1 and 3.

Figure 11:
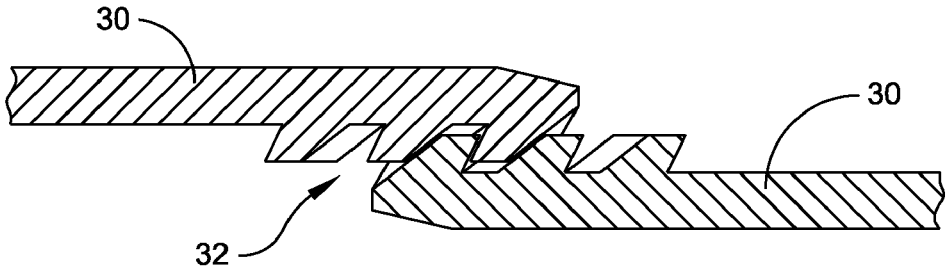
FIG. 11 is a cross-sectional view taken along line 11-11 of FIG. 10.

The latch pieces 30 such as depicted in FIGS. 3 and 4 have a slight curvature to them and are positioned so that they can mate with each other such as in the position illustrated in FIG. 10. Thus, the latch pieces are supported from the respective arms at the proper position so that they can interengage. The latch pieces thus each have engagement members that can lock together the latch pieces. The engagement members are depicted herein as a ratchet mechanism 32. In this regard refer to the cross sectional view of FIG. 11 for which discloses the engaged latch pieces at the ratchet teeth depicted at 32 in FIG. 11. The ratchet teeth at 32 preferably extend only at the distal free end of each of the latch pieces 30. In the position illustrated in FIG. 10, it is noted that the latch pieces 30 are interengaged and thus the teeth engage as depicted in the cross-sectional view in FIG. 11. In order to release the latching action, one can simply press on either of the latch pieces to release the interengagement between the latch pieces 30. The spring 20, once one of the latch pieces is released, will force the arms to the position as illustrated in FIG. 3. In FIG. 3 it is noted that the latch pieces 30 are separated from each other.

In the position illustrated in FIG. 10, the latch pieces 30 are interengaged, as mentioned previously. In the partial cross-sectional view of FIG. 12, where the arms have been brought quite close together, it is noted that each of the arms is provided with a hole 36 that enables the opposed latch piece to extend therethrough. This is helpful when the arms are engaged in a sleeve that is quite narrow wherein the arms will be placed close together. In this way, the latch pieces do not interfere with the closing of arms in a small sleeve area. In FIG. 12 it is moreover noted that the latch areas at 32 are not engaged with each other and thus the latch pieces are free to move through the opposed holes 36. Regarding the holes 36, refer also to FIGS. 1, 6 and 8.

FIG. 13 is a somewhat schematic top plan view of the ironing aid as inserted into a piece of clothing C. FIG. 13 the clothing is shown in dotted outline and the end pieces 19 are shown engaged with the inside of the clothing. The clothing may be a sleeve of a shirt. FIG. 14 is also a somewhat schematic top plan view of the ironing aid but with the ironing aid having been almost fully withdrawn from the sleeve. This withdrawing of the aid is illustrated by the arrow X in FIG. 14. Even in that position, it is noted that the latch pieces are engaged but in that position usually the ratchet teeth are not engaged. FIG. 15 is also a further somewhat schematic top plan view of the ironing aid as now released from the clothing and illustrating the manner in which the latch mechanism is kept engaged as the ironing aid is withdrawn from the clothing. This prevents a harsh opening of the arms which is to be prevented. As noted in FIG. 15, the latch pieces are still engaged and would be engaged in the manner illustrated in FIG. 11 where the ratchet teeth are engaged with each other. In order to release the latch pieces, either one of the latch pieces may be moved away from the corresponding one to release the teeth. The spring will then enable the arms to separate to the fully open position such as illustrated in FIGS. 1 and 3.

Figure 16:
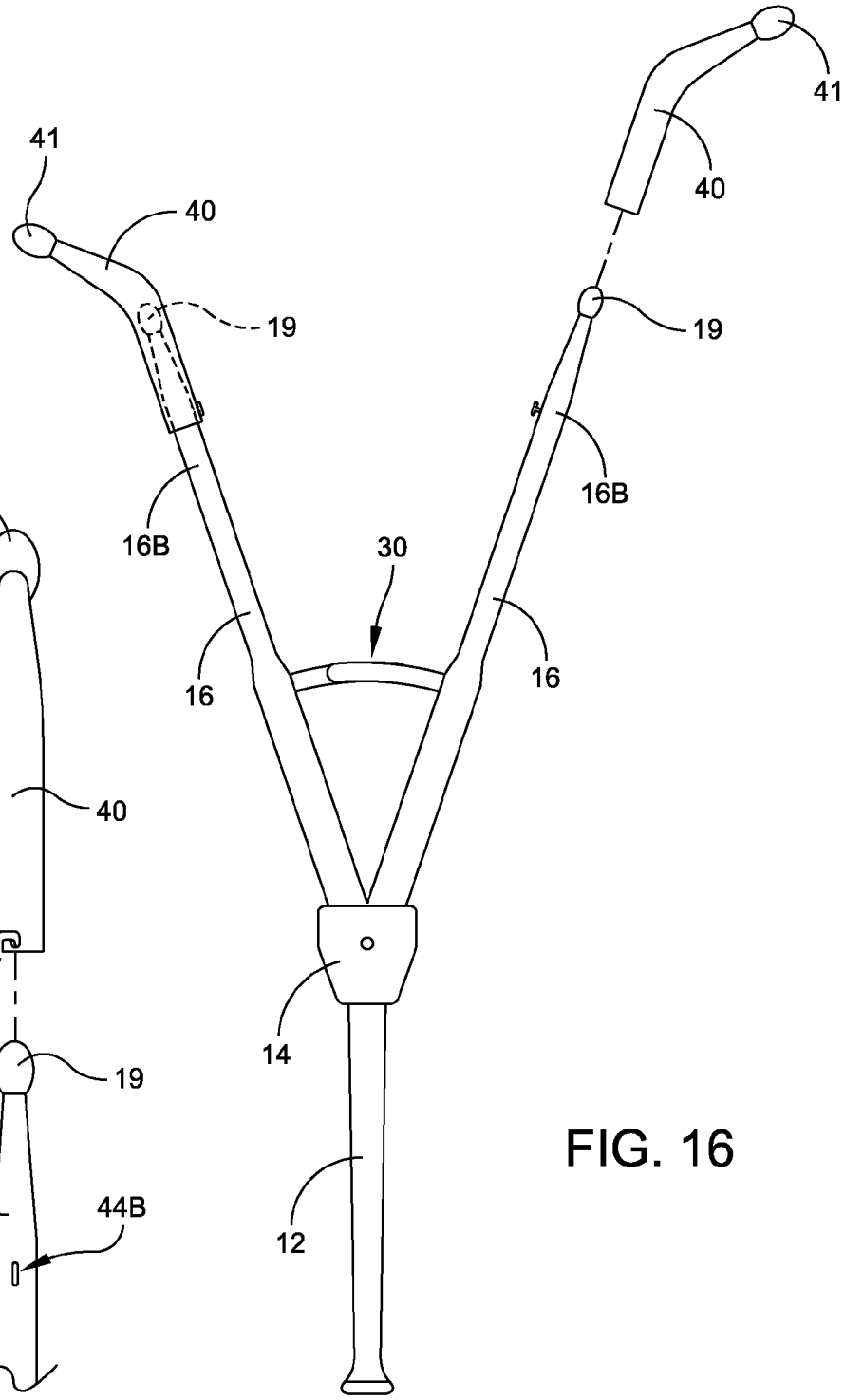
FIG. 16 is a top plan view of an alternate embodiment in which an extension is added to each arm.
Figure 17:
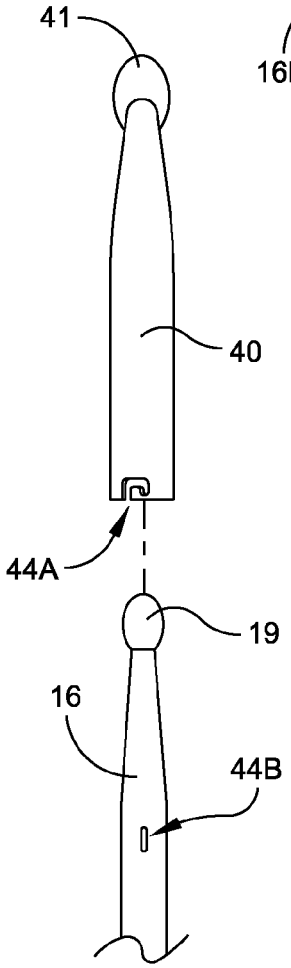
FIG. 17 is a fragmentary side view related to the embodiment of FIG. 16 illustrating further details of the mount for the extension.

Reference is now made to FIGS. 16 and 17 for a further additional feature that may be provided with the ironing aid of the present invention. This involves the use of a clip-on or mating extension 40. The extension 40 is preferably formed in an angled manner as illustrated in FIG. 16 and includes an end piece 41 that may be substantially identical to the piece 19 at the end of the respective arms 16. The extension 40 is hollow and is thus fitted over the free end of each of the arm sticks 16B. A bayonet-type interlock may be provided as illustrated in FIG. 17 at 44A, 44B. This interlock provides for a securing of the extensions to the extending arms. The purpose of the extensions is to widen the position of the arms and is particularly useful for use with wider clothing openings.

Figure 18:
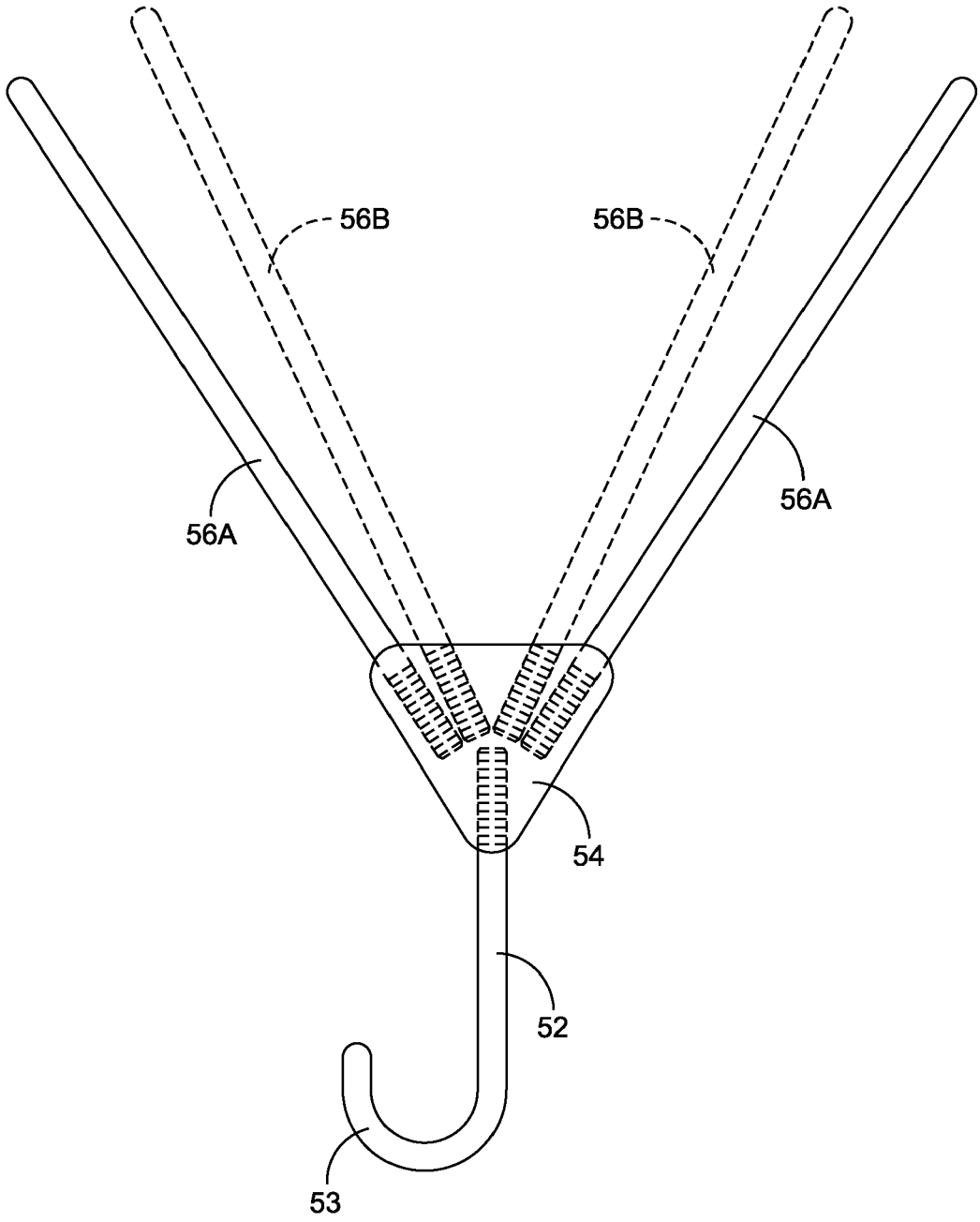
FIG. 18 is a schematic view illustrating the manner in which two sets of arms can be mounted.

Reference is now made to FIG. 18 for still another embodiment of the present invention that is particularly useful when the ironing aid is used as a traveling device. For that purpose, it is desired that the ironing aid be able to be at least partially dismantled. FIG. 18 is a schematic view in which the handle 52 has a hook end 53. This hook end 53 also enables the entire device to be used as a hanger by inverting it from the position illustrated in FIG. 18. FIG. 18 also illustrates the support block 54. In this case, there is also provided two sets of arms identified in FIG. 18 as a first set 56A and a second set 56B. Usually only one of the sets is used at a time. Each of these sets, as well as the handle 52 is adapted to be screwed into a base part of the support block. In that way each of the arms and handle can be unscrewed for easy storage of the overall device. This makes for a quite compact arrangement that can be contained in a small storage bag or case. In FIG. 18 the arms 56A and 56B function substantially in the same manner as described previously in connection with FIGS. 1-17 herein.

Reference has been made hereinbefore to FIG. 2 for an illustration of the manner in which the ironing aid is used in association with a normal ironing method. Thus, in accordance with the present invention there is provided a method of ironing clothing by means of an ironing aid that is manipulated by a user and that is comprised of a handle that supports a pair of arms each having a distal clothing contact end for contact inside of the clothing such as illustrated in FIG. 2. As also discussed previously, the arms are biased towards an open position. The spring associated with the arms will force the arms toward an open position with the exception of the locking provided by the latch pieces. In accordance with the method, it includes the steps of at least partially closing the arms against the bias of the spring. This would occur when the user wants to initially insert the ironing aid into a sleeve or pant leg. Next is the step of inserting the arms within the clothing while at least partially closed. Next is the step of releasing the arms so that the arms engage portions of the clothing thus holding the clothing in a relatively taut state and ready for ironing. This is illustrated quite well in FIG. 2 where the arms are shown spread apart contacting opposed sides of the sleeve. The next step in the method is the sweeping of the arms along the clothing in advance of the iron aid so as to enable a pressing action by the iron as the ironing aid is moved in a swept manner inside the clothing. Accordingly, when the ironing aid is first inserted, it would be inserted as far into the sleeve as possible and then slowly withdrawn in a direction out of the sleeve as the sleeve is ironed. The iron I as depicted in FIG. 2, would typically be used in close proximity to the ironing aid so that the clothing can be ironed as the ironing aid is slowly withdrawn. This withdrawal of the ironing aid is depicted by the arrow X in, for example, FIG. 14.

Having now described a limited number of embodiments of the present invention, it should now be apparent to one skilled in the art that numerous other embodiments and modifications thereof are contemplated as falling within the scope of the present invention.

What is claimed is:

1. An ironing aid for assisting in ironing of clothing, said ironing aid comprising:

a handle extending along a longitudinal axis and including proximal and distal ends with the proximal end for grasping by a user;

a support block having one and other ends with the handle mounted at the one end thereof;

a pair of arms each having respective proximal and distal ends with the distal ends thereof for contact inside of the clothing to enable a pressing action by an iron as the ironing aid is moved inside the clothing, said pair of arms capable of transitioning between open and more closed positions;

a pivots for respectively supporting the pair of arms on either side of the longitudinal axis and from the other side of the support block;

a spring disposed between the pair of arms for biasing the arms to an open position to contact inside the clothing;

and a pair of latch pieces that are supported respectively from the pair of arms in relative facing direction.

2. The ironing aid of claim 1 wherein the spring comprises one of a torsion spring and a leaf spring having respective ends that contact the arms.

3. The ironing aid of claim 1 wherein the other end of the support block is open to receive the pair of arms therein.

4. The ironing aid of claim 1 wherein the pivot comprises a pivot pin that extends orthogonal to the longitudinal axis of the handle.

5. The ironing aid of claim 1 including a hole disposed in each arm for receiving the opposed latch piece.

6. The ironing aid of claim 1 wherein the pair of latch pieces each have engagement members that lock together the latch pieces.

7. The ironing aid of claim 6 wherein the engagement members include a ratchet mechanism between the pair of latch pieces.

8. The ironing aid of claim 1 including an extension mounted at the distal end of each of the arms.

9. The ironing aid of claim 1 wherein each arm includes an arm base that is pivotally supported from the support block and an arm stick supported from the base, the arm base having a channel for receiving the arm stick, the arm stick having at a distal end thereof a contact piece.

10. An ironing aid for assisting in ironing of clothing including at least pants and shirts by extending inside of a sleeve or pant leg, said ironing aid comprising:

an elongated handle extending along a longitudinal handle axis and including proximal and distal ends with the proximal end for grasping by a user for insertion into a sleeve or pant leg;

a support block having one and other ends with the handle mounted at the one end thereof;

a pair of arms each having respective proximal and distal ends with the distal ends thereof for contact inside of the pant leg or sleeve to provide a pressing action by an iron as the ironing aid is moved inside the clothing in advance of the iron, said pair of arms capable of transitioning between open and more closed positions;

means for pivotally and respectively supporting the pair of arms on either side of the longitudinal axis and from the other side of the support block;

spring means for biasing the arms to an open position to contact inside the pant leg or sleeve;

and a pair of latch pieces that are supported respectively from the pair of arms in relative facing direction.

11. The ironing aid of claim 10 wherein the spring means comprises one of a torsion spring and a leaf spring having respective ends that contact the arms.

12. The ironing aid of claim 10 wherein the other end of the support block is open to receive the pair of arms therein, and the means for supporting the arms comprises a pivot pin that extends orthogonal to the longitudinal axis of the handle.

13. The ironing aid of claim 10 including hole disposed in each arm for receiving the opposed latch piece.

14. The ironing aid of claim 10 wherein the pair of latch pieces each have engagement members that lock together the latch pieces, and wherein the engagement members include a ratchet mechanism between the pair of latch pieces.

15. The ironing aid of claim 10 including an extension mounted at the distal end of each of the arms.

16. The ironing aid of claim 10 wherein each arm includes an arm base that is pivotally supported from the support block and an arm stick supported from the base, the arm base having a channel for receiving the arm stick, the arm stick having at a distal end thereof a contact piece.

17. A method of ironing clothing by means of an ironing aid manipulated by a user and that is comprised of a handle that supports a pair of arms each having a distal clothing contact end for contact inside of the clothing, the arms biased to enable the arms to be spread apart, said method comprising:

at least partially closing the arms against the bias;

inserting the arms within the clothing while at least partially closed;

next releasing the arms so that the arms engage portions of the clothing thus holding the clothing in a taut state ready for ironing;

sweeping the arms along the clothing in advance of an ironing step so as to enable a pressing action by the iron as the ironing aid is moved in a swept manner inside the clothing;

and holding the arms in a particular position therebetween by means of a latch mechanism.

18. The method of claim 17 including extending the length of the arms by adding an extension mounted at the distal end of each of the arms.

19. The method of claim 17 including supporting the latch mechanism between the arms.

20. The method of claim 17 including releasing the latch mechanism so that the arms can be biased apart.

* * * * *